United States Patent [19]

Coffindaffer et al.

[11] Patent Number: 5,071,573

[45] Date of Patent: Dec. 10, 1991

[54] MICROEMULSIFIED SILICONES IN LIQUID FABRIC CARE COMPOSITIONS CONTAINING DYE

[75] Inventors: Timothy W. Coffindaffer, Loveland; Geraldine M. Coffey, Cincinnati, both of Ohio

[73] Assignee: The Procter & Gamble Company, Cincinnati, Ohio

[21] Appl. No.: 557,437

[22] Filed: Jul. 23, 1990

[51] Int. Cl.[5] ..... D06M 13/34

[52] U.S. Cl. ..... 252/8.8; 8/137; 252/312

[58] Field of Search ..... 252/312, 8.8, 8.6; 8/137

[56] References Cited

U.S. PATENT DOCUMENTS

| | | | |
|---|---|---|---|
| 4,052,331 | 10/1977 | Dumoulin | 252/312 |
| 4,525,281 | 6/1985 | Cooper | 210/735 |
| 4,620,878 | 11/1986 | Gee | 106/287.15 |
| 4,733,677 | 3/1988 | Gee et al. | 132/7 |
| 4,822,499 | 4/1989 | Wahl et al. | 252/8.8 |
| 4,863,620 | 9/1989 | Coffindaffer | 252/8.8 |
| 4,897,208 | 1/1990 | Wahl et al. | 252/8.6 |
| 4,994,193 | 2/1991 | Wahl | 252/8.8 |

FOREIGN PATENT DOCUMENTS

| | | |
|---|---|---|
| 0228575 | 11/1986 | European Pat. Off. . |
| 2215729A | 12/1988 | United Kingdom . |

*Primary Examiner*—A. Lionel Clingman

*Attorney, Agent, or Firm*—Robert B. Aylor; Richard C. Witte

[57] ABSTRACT

This invention relates to fabric care compositions comprising microemulsified silicone and dye, preferably in liquid fabric softener/silicone compositions and/or liquid detergent/silicone compositions. The aesthetic effect of the dye is greater for such compositions that similar compositions containing macroemulsions.

24 Claims, No Drawings

MICROEMULSIFIED SILICONES IN LIQUID FABRIC CARE COMPOSITIONS CONTAINING DYE

FIELD OF THE INVENTION

This invention relates to fabric care compositions for treating fabrics containing silicone microemulsions and dye.

BACKGROUND OF THE INVENTION

The use of silicones for softening fabrics, i.e., providing lubrication between fibers and yarns so that they move over one another more easily, has been well known for quite some time. In addition, the use of organomodified silicones for textile treatments has also been well documented over the years. (See U.S. Pat. Nos.: 4,620,878, Gee, issued Nov. 4, 1986; 4,705,704, Lane et al., issued Nov. 10, 1987; 4,800,026, Coffindaffer et al., issued Jan. 24, 1989; 4,824,877, Glover et al., issued Apr. 25, 1989; and 4,824,890, Glover et al., issued Apr. 25, 1989; also of interest is Brit. Pat. Appln. 87-29,489, Walbeoff, published Dec. 18, 1987, all of said patents and said application being incorporated herein by reference.) Silicones of these types are typically delivered to textiles in the form of aqueous emulsions. More recently, much work has concentrated on aqueous delivery systems containing silicone microemulsions. Microemulsions have been disclosed as having two advantages over conventional "macro" emulsions: (1) they are allegedly more stable and (2) they allegedly can require less mechanical energy to make.

Dyes are often used in consumer products to provide pleasing aesthetics. In the case of fabric care products, one wants to be able to provide the desired color aesthetics with as little dye as possible to minimize chances for staining clothes. Thus, one likes to be able to formulate with as low a level of dye as possible, yet provide a pleasant color aesthetic.

It is therefore an object of the present invention to provide aesthetically pleasing fabric care/microemulsified silicone compositions with lower dye levels than are required to provide the same effect in fabric care compositions containing conventional silicone macroemulsions.

SUMMARY OF THE INVENTION

This invention relates to fabric care compositions comprising microemulsified silicone fabric care agent for use in fabric cleaning operations whereby said microemulsified silicone agent is incorporated into a fabric care composition with dye levels that provide an aesthetically pleasing product color, yet which are relatively low as compared to the dye levels required to provide the same color when macroemulsified silicone agent is present.

DETAILED DESCRIPTION OF THE INVENTION

This invention relates to microemulsified silicone compositions for fabric care which require only low dye levels to at least partially disguise the presence of the silicone emulsion. In another respect, this invention relates to methods of using such microemulsified silicone compositions containing dye in the care of fabrics. Preferred compositions are aqueous liquids which can also include fabric softener material or detergent ingredients. Such compositions are usually added to either the wash, or rinse, water of a laundering operation. These preferred compositions are organic solvent or aqueous based, water-dispersible fabric care compositions which contain from about 0.05% to about 20%, preferably from about 0.1% to about 10%, and more preferably from about 0.2% to about 5% of microemulsified silicone fabric care agent; and from about 0.1 ppm to about 1000 ppm, preferably from about 1 ppm to about 500 ppm, more preferably from about 50 ppm to about 200 ppm of dye.

Silicone Microemulsions

Over the last 5 years, many patents issued disclosing silicone microemulsions (U.S. Pat. Nos.: 4,620,878; 4,824,877; 4,824,890, and Brit. Pat. Appln. 87-29,489, suora: all of said patents being incorporated herein by reference). In this literature, silicone microemulsions have been described as translucent silicone emulsions with average particle sizes smaller than 0.14 microns. Microemulsions are claimed to have two advantages over conventional "macro" emulsions: (1) they are more stable and (2) they require less mechanical energy to make.

The silicones herein preferably have an average molecular weight of from about 1,000 to about 100,000, preferably from about 1,000 to 50,000, more preferably from about 1,500 to about 20,000, and can be prepared by emulsion polymerization of low molecular weight polymers and/or monomers, more preferably low molecular weight polymers. Emulsion polymerization can provide a high concentration of microemulsified silicone.

Dyes

Any suitable dye (colorant) can be used in the compositions herein. Preferably, the dye is water-soluble and/or nonstaining and is present in an amount from about 0.1 ppm to about 1,000 ppm, preferably from about 1 ppm to about 500 ppm, more preferably from about 5 ppm to about 200 ppm.

Suitable dyes are disclosed in U.S. Pat. Nos.: 3,216,944, Frederickson, issued Nov. 9, 1965; 4,844,820, Piper et al., issued July 4, 1989; 4,863,620, Coffindaffer, issued Sept. 5, 1989; and 4,897,208, Wahl et al., issued Jan. 30, 1990, all of said patents being incorporated herein by reference. Other suitable dyes are disclosed in the other patents incorporated herein by reference.

C.I. Acid Blue #127:1; C.I. Acid Blue #254; C.I. Direct Blue #199; C.I. Reactive Red #147; C.I. Acid Yellow #79 and #218; and C.I. Direct Yellow #12 have been disc osed specifically. Ultra-marine Blue is an especially desirable colorant.

Liquid Fabric Softener/Microemulsified Silicone Compositions

In a preferred execution, about 0.1% to about 10% by weight of microemulsified silicone is mixed into a suitable laundry liquid fabric softener composition containing dye. The resulting fabric care composition has essentially the same color as the original composition whereas addition of a conventional macroemulsion would require considerable additional dye to keep the desired color. Thus, e.g., when one incorporates a microemulsified silicone fabric care material into a liquid fabric softener composition, only a little color change is observed (the color change is similar to water dilution), resulting in an aesthetically pleasing fabric softener without the addition of more dye, or with the addition of a much lesser amount of dye as compared to when the corresponding macroemulsion is used.

One preferred composition of this invention is an aqueous dispersion comprising: a microemulsified silicone fabric care agent wherein the weight ratio of microemulsified silicone to fabric softener active material is from about 17:1 to about 1:350, preferably from about 10:1 to about 1:100. Some more preferred weight ratios of preferred microemulsified amine functional silicone to fabric softener active material are from about 1:1 to about 1:10 and preferably from about 1:5 to about 1:10.

Suitable fabric softener(s) (active materials) are selected from the group consisting of:

i. quaternary ammonium compound;
ii. fatty amine compound;
iii. fatty amide compound;
iv. fatty acids;
v. fatty alcohols; and
vi. mixtures thereof.

In certain liquid rinse-added compositions of this invention the amount of fabric softener can range from about 2% to about 35%, preferably from about 4% to about 27%, by weight of the total composition. The lower limits are amounts needed to contribute effective fabric softening performance when added to laundry rinse baths in the manner which is customary in home laundry practice. The higher limits are suitable for more concentrated liquid products which require smaller volume usage.

The preferred levels of microemulsified, preferable amine functional, silicone fabric care agent in such compositions can range from about 0.05% to about 40%; preferably from about 0.1% to about 20%; and more preferably from about 0.5% to about 10% by weight of the composition.

Suitable fabric softener active materials (compounds) include quaternary ammonium salts, as well as nonquaternary amines and amine salts, and/or amides.

Compositions containing cationic nitrogenous compounds in the form of quaternary ammonium salts and substituted imidazolinium salts having two long chain acyclic aliphatic hydrocarbon groups provide fabric softening benefits when used in laundry rinse operations. (See, for example, U.S. Pat. Nos. 3,644,203, Lamberti et al., issued Feb. 22, 1972; and 4,426,299, Verbruggen, issued Jan. 17, 1984; also "Cationic Surface Active Agents as Fabric Softeners," R. R. Egan, Journal of the American Oil Chemists' Society, January 1978, pages 118-121; and "How to Choose Cationics for Fabric Softeners," J. A. Ackerman, Journal of the American Oil Chemists' Society, June 1983, pp. 1166-1169, all of said patents and references being incorporated herein by reference.)

Other suitable fabric softening compounds are the nonquaternary amides and the nonquaternary amines. A desirable material is the reaction product of higher fatty acids with hydroxyalkylalkylenediamines. Examples of these materials are the reaction products of higher fatty acids and hydroxyethylethylenediamine (See "Condensation Products from beta-hydroxyethylethylenediamine and Fatty Acids or Their Alkyl Esters and Their Application as Textile Softeners in Washing Agents," H. W. Eckert, Fette-SeifenAnstricmittel, September 1972, pages 527-533, incorporated herein by reference). These materials are usually disclosed and suggested generically along with other cationic quaternary ammonium salts and imidazolinium salts as softening actives in fabric softening compositions. (See U.S. Pat. Nos.: 4,460,485, Rapisarda et al., issued July 17, 1984; 4,421,792, Rudy et al., issued Dec. 20, 1983; and 4,327,133, Rudy et al., issued Apr. 27, 1982, all of said patents being incorporated herein by reference).

A particularly preferred fabric softener is in the form of an aqueous dispersion comprising from about 2% to about 35% by weight of a mixture consisting of:

(a) from about 10% to about 92% of the reaction product of a higher fatty acid with a polyamine selected from the group consisting of hydroxyalkylalkylenediamines and dialkylenetriamines and mixtures thereof, and
(b) from about 8% to about 90% of cationic nitrogenous salts having only one long chain acyclic aliphatic $C_{15}$-$C_{22}$ hydrocarbon group, and optionally
(c) from 0% to about 80% of a cationic nitrogenous salt having two or more long chain acyclic aliphatic $C_{15}$-$C_{22}$ hydrocarbon groups or one said group and an arylalkyl group having from about 15 to about 22 carbon atoms in its alkyl chain.

For a detailed description of some preferred fabric softeners, see commonly assigned U.S. Pat. No. 4,661,269, Trinh/Wahl/Swartley/Hemingway, issued Apr. 28, 1987, incorporated herein by reference in its entirety.

The terms herein, e.g., softener compound, in general, denote both singular and plural unless otherwise specified.

Preferred carriers are liquids selected from the group consisting of water and mixtures of water and short chain $C_1$-$C_4$ monohydric alcohols. The water which is used can be distilled, deionized, and/or tap water. Mixtures of water and up to about 10%, preferably less than about 5%, of short chain alcohol such as ethanol, propanol, isopropanol or butanol, and mixtures thereof, are also useful as the carrier liquid. Carriers which are primarily water are desirable.

Some short chain alcohols are present in commercially available quaternary ammonium compound products. Such products can be used in the preparation of preferred aqueous compositions of the present invention. The short chain alcohols are normally present in such products at a level of from about 0.5% to about 10% by weight of the aqueous compositions.

Some Optional Ingredients and Preferred Embodiments

Compatible adjuvants can be added to the compositions herein for their known purposes. Such adjuvants include, but are not limited to, viscosity control agents, perfumes, emulsifiers, preservatives, antioxidants, bactericides, fungicides, brighteners, opacifiers, freeze-thaw control agents, soil release agents, and shrinkage control agents, and other agents to provide ease of ironing (e.g., starches, etc.). These adjuvants, if used, are added at their usual levels, generally each of up to about 5% by weight of the preferred liquid composition.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the liquid compositions herein, and later to obtain the desired viscosity. The amount of ionizable salts used depends on the amount of active ingredients used in such compositions and can be adjusted according to the desires of the formulator. Typical levels of salts used to control the composition viscosity are from about 20 to about 6,000 parts per million (ppm), preferably from about 20 to about 4,000 ppm by weight of the composition.

Soil release agents, usually polymers, are desirable additives at levels of from about 0.1% to about 5%. Suitable soil release agents are disclosed in U.S. Pat. Nos. 4,702,857, Gosselink, issued Oct. 27, 1987; 4,711,730, Gosselink and Diehl, issued Dec. 8, 1987; 4,713,194, Gosselink issued Dec. 15, 1987; and mixtures thereof, said patents being incorporated herein by reference. Other soil release polymers are disclosed in U.S. Pat. Nos.: 4,749,596, Evans, Huntington, Stewart, Wolf, and Zimmerer, issued June 7, 1988; 3,928,213, Temple, Heuring, and Prentice, issued Dec. 23, 1975; 4,136,038, Pracht and Burns, issued Jan. 23, 1979; and 4,661,267, Dekker, Konig, Straathof, and Gosselink, issued Apr. 28, 1987, said patents being incorporated herein by reference.

Typical levels of compatible bactericides used in the present compositions are from about 1 to about 1,500 ppm by weight of the composition.

Examples of antioxidants that can be added to the compositions of this invention are propyl gallate, available from Eastman Chemical Products, Inc., under the trade names Tenox ® PG and Tenox S-1, and butylated hydroxy toluene, available from UOP Process Division under the trade name Sustane ® BHT.

The compositions can contain other silicone fluids to provide additional benefits such as improved fabric feel. These adjunct silicones can be used as is, making sure the silicone fluid is sufficiently incorporated into the formula so that it does not phase separate.

A preferred composition contains from about 1 ppm to about 1,000 ppm of bactericide, from about 0.2% to about 2% of perfume, from 0% to about 3% of polydimethylsiloxane, from 0% to about 0.4% of calcium chloride, from about 10 ppm to about 100 ppm of dye, and from 0% to about 10% of short chain alcohols, by weight of the total composition.

The pH of the preferred compositions of this invention is generally adjusted to be in the range of from about 2 to about 11, preferably from about 2 to about 8. Adjustment of pH is normally carried out by including a small quantity of free acid or free base in the formulation. Any acidic material can be used; its selection can be made by anyone skilled in the softener arts on the basis of cost, availability, safety, etc. Any suitable acid can be used to adjust pH. Preferred are hydrochloric, sulfuric, phosphoric and formic acid. Similarly, any suitable base, e.g., sodium hydroxide, can also be used to adjust pH. For the purposes of this invention, pH is measured by a glass electrode in full strength softening composition in comparison with a standard calomel reference electrode.

Liouid Deteroent/Microemulsified Silicone Comoosiitions

In another preferred execution, a similar amount of microemulsified silicone fabric care agent is mixed into a suitable liquid detergent or, preferably, detergent-/softener composition containing dye, e.g., BOLD ® LIQUID. Care must be taken to use emulsifiers in the microemulsion that are compatible with the detergent surfactants to avoid demulsification. The new liquid detergent/silicone-microemulsion product yields a clear translucent liquid similar in color to the original product. However, if one incorporates a conventional silicone macroemulsion into such a detergent, or detergent/softener composition, one obtains a cloudy product unlike the parent product. Thus, the use of microemulsified silicones permits one to include the benefits of silicones without having to drastically rebalance product aesthetics.

Preferred compositions are aqueous liquids which are added to the wash. Such compositions are usually added to the wash water of a laundering operation. These preferred compositions are organic solvent, or aqueous, based, water-dispersible liquid detergents which contain from about 0.05% to about 20%, preferably from about 0.1% to about 10%, more preferably from about 0.2% to about 5% of microemulsified silicone fabric care agent. The level of silicone for any detergent composition is desirably less than the level which will give a visually detestable change in the appearance of said composition (e.g., cloudiness). The compositions are diluted in the wash.

In a preferred liquid detergent execution, about 0.1% to about 10% by weight of a microemulsified silicone fabric care agent is mixed into a suitable commercially available liquid laundry detergent composition. The result is a liquid detergent composition. There are many suitable, commercially-available, liquid detergent compositions (anionic/nonionic, etc., surfactant based detergent, e.g., LIQUID TIDE ®, or a nonionic surfactant based detergent/softener, e.g., BOLD3 ® LIQUID). Care must be taken to use silicone emulsifiers which are compatible with the detergent surfactants to avoid demulsification of the silicone.

The present invention also includes liquid detergent compositions comprising an effective amount of microemulsified silicone fabric care agent and a liquid detergent composition selected from those disclosed in U.S. Pat. Nos. 4,318,818, Letton et al., issued Mar. 9, 1982; 4,507,219, Hughes, issued Mar. 26, 1985; and 4,713,194, Gosselink et al., issued Dec. 15, 1987, all incorporated herein by reference.

Detergent Surfactants

The amount of detergent surfactant included in the detergent compositions of the present invention can vary from about 1% to about 75% by weight of the composition depending upon the detergent surfactant(s) used and the type of composition to be formulated. Preferably, the detergent surfactant(s) comprises from about 10% to about 50% by weight of the composition, and most preferably from about 15% to about 40% by weight. The detergent surfactant can be nonionic, anionic, amphoteric, switterionic, cationic, or mixtures thereof:

A. Nonionic Surfactants

Suitable nonionic surfactants for use in detergent compositions of the present invention are generally disclosed in U.S. Pat. No. 3,929,678, Laughlin et al., issued Dec. 30, 1975, at column 13, line 14 through column 16, line 6 (herein incorporated by reference). Classes of nonionic surfactants included are:

The polyethylene oxide condensates of alkyl phenols. Commercially available nonionic surfactants of this type include Igepal CO-630, marketed by the GAF Corporation, and Triton X-45, X-114, X-100, and X-102, marketed by the Rohm and Haas Company.

2. The condensation products of aliphatic alcohols with from about 1 to about 25 moles of ethylene oxide. Examples of commercially available nonionic surfactants of this type include Tergitol 15-S-9, marketed by Union Carbide Corporation, Neodol 45-9, Neodol 23-6.5, Neodol 45-7, and Neodol 45-4, marketed by Shell Chemical Company, and Kyro EOB, marketed by The Procter & Gamble Company.

3. The condensation products of ethylene oxide with a hydrophobic base formed by the condensation of propylene oxide with propylene glycol. Examples of compounds of this type include certain of the commercially available Pluronic surfactants, marketed by Wyandotte Chemical Corporation.

4. The condensation products of ethylene oxide with the product resulting from the reaction of propylene oxide and ethylenediamine. Examples of this type of nonionic surfactant include certain of the commercially available Tetronic compounds, marketed by Wyandotte Chemical Corporation.

5. Semi-polar nonionic detergent surfactants which include water-soluble amine oxides containing one alkyl moiety of from about 10 to about 18 carbon atoms and 2 moieties selected from the group consisting of alkyl groups and hydroxylalkyl groups containing from 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from 1 to about 3 carbon atoms.

6. Alkylpolysaccharides disclosed in European Patent Application No. 70,074, R.A. Llenado, published Jan. 19, 1983, having a hydrophobic group containing from about 6 to about 30 carbon atoms, preferably from about 10 to about 16 carbon atoms and a polysaccharide, e.g., a polyglycoside, hydrophilic group containing from about 1½ to about 3, most preferably from about 1.6 to about 2.7 saccharide units.

7. Fatty acid amide detergent surfactants having the formula:

$$R^6-\overset{\overset{\displaystyle O}{\|}}{C}-NR_2^7$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3. Preferred amides are $C_8$–$C_{20}$ ammonia amides, monoethanolamides, diethanolamides, and isopropanol amides.

B. Anionic Surfactants

Anionic surfactants suitable in detergent compositions of the present invention are generally disclosed in U.S. Pat. No. 3,929,678, suora. at column 23, line 58 through column 29, line 23 (herein incorporated by reference). Classes of anionic surfactants included are:

Ordinary alkali metal soaps such as the sodium, potassium, ammonium and alkylolammonium salts of higher fatty acids containing from about 8 to about 24 carbon atoms, preferably from about 10 to about 20 carbon atoms.

2. Water-soluble salts, preferably the alkali metal, ammonium and alkylolammonium salts, or organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups).

Especially valuable are linear straight chain alkylbenzene sulfonates in which the average number of carbon atoms in the alkyl group is from about 11 to 13, abbreviated as $C_1$–$C_{13}$ LAS.

Preferred anionic surfactants of this type are the alkyl polyethoxylate sulfates, particularly those in which the alkyl group contains from about 10 to about 22, preferably from about 12 to about 18 carbon atoms, and wherein the polyethoxylate chain contains from about 1 to about 15 ethoxylate moieties, preferably from about 1 to about 3 ethoxylate moieties. These anionic detergent surfactants are particularly desirable for formulating heavy-duty liquid laundry detergent compositions.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 unit of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Also included are water-soluble salts of esters of alphasulfonated fatty acids.

3. Anionic phosphate surfactants.

4. N-alkyl substituted succinamates.

C. Amphoteric Surfactants

Amphoteric surfactants can be broadly described as aliphatic derivatives of secondary or tertiary amines, or aliphatic derivatives of heterocyclic secondary and tertiary amines in which the aliphatic radical can be straight chain or branched and wherein one of the aliphatic substituents contains from about 8 to about 18 carbon atoms and at least one contains an anionic water-solubilizing group, e.g., carboxy, sulfonate, sulfate. See U.S. Pat. No. 3,929,678, suora. at column 19, lines 18–35 (herein incorporated by reference) for examples of amphoteric surfactants.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678, supra. at column 19, line 38 through column 22, line 48 (herein incorporated by reference) for examples of Zwitterionic surfactants.

E. Cationic Surfactants

Cationic surfactants can also be included in detergent compositions of the present invention. Useful cationic surfactants are disclosed in U.S. Pat. No. 4,259,217, Murphy, issued Mar. 31, 1981, herein incorporated by reference.

Detergent Builders

Detergent compositions of the present invention can optionally comprise inorganic or organic detergent builders to assist in mineral hardness control. When included, these builders typically comprise up to about 60% by weight of the detergent composition. Built liquid formulations preferably comprise from about 1% to about 25% by weight detergent builder, most preferably from about 3% to about 20% by weight, while built granular formulations preferably comprise from about 5% to about 50% by weight detergent builder, most preferably from about 10% to about 30% by weight.

Carriers

Preferred carriers are liquids selected from the group consisting of water and mixtures of the water and short chain $C_1$–$C_4$ monohydric alcohols and/or polyols containing 2–6 carbon atoms. A more detailed discussion of solvent systems (carriers) is disclosed in U.S. Pat. No. 4,507,219, suora. at columns 7 and 8.

Optional Components

Optional components for use in the liquid detergents herein include enzymes, enzyme stabilizing agents, polyacids, soil removal agents, antiredeposition agents, suds regulants, hydrotropes, opacifiers, antioxidants, bactericides, dyes, perfumes, and brighteners described in U.S. Pat. No. 4,285,841, Barrat et al., issued Aug. 25, 1981, incorporated herein by reference. Such optional components generally represent less than about 15%, preferably from about 2% to about 10%, by weight of the composition.

A more detailed discussion of optional components is found in U.S. Pat. No. 4,507,217, supra, at columns 8 and 9.

The compositions of the present invention can be prepared by a number of methods including simple mixing. Some convenient and satisfactory methods are disclosed in the following nonlimiting examples.

All percentages, parts, and ratios herein are by weight unless otherwise specified.

EXAMPLE I

A liquid fabric softener composition containing a microemulsified silicone is prepared in the following manner. Approximately: 17.5 parts Mazamide 6; 6.5 parts di(hydrogenatedtallowalkyl)dimethylammonium chloride (DTDMAC); and 2.07 parts isopropyl and/or alcohols (from actives) are weighed into a premix vessel.

After heating to about 75° C. and mixing, the premix is added, with agitation, to a mix vessel (44° C.) containing distilled water. Then about 1.32 parts of perfume is added to this "main" mix. The main mix is then cooled to about 21° C., to which is added with stirring about 12.00 parts microemulsified amine functional silicone (about 14% silicone) and about 0.00072 parts dye. The amine functional silicone and dye are defined hereinafter.

EXAMPLE II

A microemulsified amine functional silicone and fabric softener composition is prepared using the procedure in Example I. The ingredients are, approximately: 2.00 parts Mazamide 6; 0.80 parts mono(hydrogenatedtallowalkyl)trimethylammonium chloride (MTTMAC); 4.03 parts DTDMAC; 0.42 parts perfume, 1.28 parts alcohol (from actives); 10.00 parts 14% micro emulsified amine functional silicone of Example I; 0.00025 parts dye; and the balance is distilled water. See Table 1 and Example I for a recap of the ingredients and method of preparation. Examples I and II both exhibit aesthetically pleasant colored products.

TABLE 1

| Ingredient | Example I Wt. % | Example II Wt. % |
|---|---|---|
| Mazamide 6[1] | 17.50 | 2.00 |
| MTTMAC[2] | — | 0.80 |
| DTDMAC[3] | 6.53 | 4.03 |
| Perfume | 1.32 | 0.42 |
| Polar Brilliant Blue Dye | 0.00072 | 0.00025 |
| Alcohol (from actives) | 2.07 | 1.28 |
| Micro Emulsified Amine Functional Silicone[4] | 12.00 | 10.00 |
| Distilled Water | Balance | Balance |

[1]Reaction product of 2 moles of hydrogenated tallow fatty acid with 1 mole of N-2-hydroxyethylenediamine.
[2]Mono(hydrogenatedtallowalkyl)trimethyl ammonium chloride.
[3]Di(hydrogenatedtallowalkyl)dimethyl ammonium chloride.
[4]A specialty aqueous microemulsion X2-8406 made by Dow Corning Company. It contains about 14% amine functional silicone Dow Corning Q2-8075 and a proprietary emulsification system.

COMPARISON EXAMPLES

To illustrate the advantages of this invention, a series of liquid fabric softener compositions which have been diluted with different levels of water (control), microemulsified silicone, and macroemulsified silicone (conventional silicone emulsion) were prepared.

EXAMPLE III

Liquid Fabric Softener

Using a commerically available sample of April Fresh DOWNY (blue color), samples of DOWNY containing about 10–20 ppm of dye are diluted with about 0.5, 1.0, 3.0, and 5.0 grams of either water, microemulsified silicone, (Dow Corning X2-7590), or macroemulsified silicone (Dow Corning 8 Emulsion), to yield about 100 grams of softener composition. Dow Corning X2-7590 is an experimental silicone microemulsion containing about 35% silicone solids with an estimated silicone polymer viscosity of 1,000 cs. The average particle size as measured by Dow Corning is about 40 nanometers. Dow Corning 8 Emulsion, is a commercially available silicone macroemulsion containing 35% silicone solids with an estimated silicone polymer viscosity of 1,000 cs. The average particle size of Dow Corning 8 Emulsion as mesured by Dow Corning is >300 nanometers. The samples are thoroughly mixed by shaking for about 10 seconds and then stirred with a mechanical stirrer for about 30 minutes. After equilibrating for 20 hours, the color of the samples is measured, as disclosed hereinafter, using a Hunter Colorimeter (MOdel #D25). The Hunter Colorimeter provides three values: L, A, and B. The B value is the most important for blue samples as it provides a yellow (positive B number) to blue (negative B number) color axis. Thus, the more negative the B number, the more blue the product. The L value represents lightness (white/black level) and thus represents another important value for matching product color.

TABLE 2

| DOWNY ® + Diluent Hunter Readings | | | |
|---|---|---|---|
| % DOWNY/% Diluent | L | A | B |
| Diluent = Water | | | |

TABLE 2-continued

| DOWNY ® + Diluent Hunter Readings | | | |
|---|---|---|---|
| % DOWNY/% Diluent | L | A | B |
| 100.0/0.0 | 43.08 | −5.07 | −34.39 |
| 99.5/0.5 | 43.26 | −5.08 | −34.52 |
| 99.0/1.0 | 43.29 | −5.11 | −34.37 |
| 97.0/3.0 | 43.44 | −5.01 | −35.08 |
| 95.0/5.0 | 43.57 | −4.96 | −35.50 |
| Diluent = Microemulsion | | | |
| 100.0/0.0 | 43.08 | −5.07 | −34.39 |
| 99.5/0.5 | 46.75 | −5.89 | −34.17 |
| 99.0/1.0 | 49.38 | −6.51 | −33.36 |
| 97.0/3.0 | 52.63 | −7.24 | −30.45 |
| 95.0/5.0 | 44.39 | −5.8 | −31.96 |
| Diluent = Macroemulsion | | | |
| 100.0/0.0 | 43.08 | −5.07 | −34.39 |
| 99.5/0.5 | 47.82 | −6.18 | −33.37 |
| 99.0/1.0 | 51.31 | −6.86 | −32.61 |
| 97.0/3.0 | 59.81 | −8.04 | −29.38 |
| 95.0/5.0 | 64.75 | −8.50 | −26.64 |

As shown by the LAB readings, the microemulsified silicone exhibits less of an effect on product color (compared to the macroemulsion) and thus would permit one to formulate a silicone containing blue fabric softener composition more closely to the base color. This difference is easily observed by visual examination with the microemulsion containing composition very closely resembling the control (water containing) composition.

c. EXAMPLE IV

Liquid Fabric Softener

Similarly, using a commercially available sample of SunRinse Fresh DOWNY ® (yellow color), samples of DOWNY containing about 0–20 ppm of dye are diluted with about 0.5, 1.0, 3.0, and 5.0 grams of either water, microemulsified silicone (Dow Corning X2-7590), or macroemulsified silicone (Dow Corning 8 Emulsion), to yield about 100 grams of softener composition. The samples are thoroughly mixed by shaking for about 10 seconds and then stirred with a mechanical stirrer for about 30 minutes. After equilibrating for about 20 hours, the samples are measured, as shown hereinafter, using a Hunter Colorimeter TM, as above. The data is summarized below.

TABLE 3

| DOWNY ® + Diluent Hunter Readings | | | |
|---|---|---|---|
| % DOWNY/% Diluent | L | A | B |
| Diluent = Water | | | |
| 100.0/0.0 | 62.64 | −15.35 | 21.66 |
| 99.5/0.5 | 62.89 | −15.12 | 21.57 |
| 99.0/1.0 | 62.74 | −14.98 | 21.45 |
| 97.0/3.0 | 63.41 | −14.92 | 21.35 |
| 95.0/5.0 | 64.08 | −14.94 | 21.41 |
| Diluent = Microemulsion | | | |
| 100.0/0.0 | 62.64 | −15.35 | 21.66 |
| 99.5/0.5 | 66.94 | −14.19 | 22.68 |
| 99.0/1.0 | 69.41 | −14.48 | 23.35 |
| 97.0/3.0 | 74.54 | −13.69 | 26.14 |
| 95.0/5.0 | 73.14 | −13.55 | 25.68 |
| Diluent = Macroemulsion | | | |
| 100.0/0.0 | 62.64 | −15.35 | 21.66 |
| 99.5/0.5 | 68.05 | −14.78 | 23.46 |
| 99.0/1.0 | 71.18 | −14.47 | 24.47 |
| 97.0/3.0 | 79.57 | −12.63 | 26.15 |
| 95.0/5.0 | 83.74 | −11.56 | 26.39 |

The L value is the most sensitive indication of the color differences observed for the yellow compositions. The macroemulsion lightens/whitens the yellow compositions so that the color is less desirable. The addition of microemulsified silicone exhibits less of an effect on product color (compared to the macroemulsion) and this permits one to formulate a silicone containing yellow fabric softener composition more closely resembles a water diluted composition. This difference is more easily observed by visual examination with the microemulsion containing composition very closely resembling the control (water containing) composition.

EXAMPLE V

Liquid Detergent

To illustrate the advantages of this invention, a series of liquid detergent compositions which are diluted with different levels of water (control), microemulsified silicone, and macroemulsified silicone (conventional silicone emulsion) were prepared.

Using a commercially available sample of LIQUID BOLD (blue translucent color), samples of LIQUID BOLD containing about 5–10 ppm of dye are diluted with 0.5 and 1.0 grams of either water, microemulsified silicone (Dow Corning X2-7590), or macroemulsified (Dow Corning 8 Emulsion), to yield about 100 grams of detergent/softener composition. The samples are thoroughly mixed by shaking for about 10 seconds and then stirred with a mechanical stirrer for about 30 minutes. The water and microemulsified silicone samples remain a translucent blue like the original product while the macroemulsion containing composition produce a cloudy liquid detergent/softener composition. After equilibrating for 20 hours, the samples are measured for percent transmittance at three wavelengths (450, 600, and 800 nanometers) relative to a control (water diluted composition = 100% transmittance) using a Hewlett Packard UV-Visible Spectrophotometer (Model #8451A). The percent transmittance permits one to measure the attenuation of light due to scatter; i.e., the deviation from the parent translucent material.

TABLE 4

| % Transmittance for LIQUID BOLD ® + Diluent | | | |
|---|---|---|---|
| Wave Length (nm) = | 400 | 600 | 800 |
| Diluent = Water | | | |
| % BOLD/% Water | | | |
| 99.5/0.5 | 100 | 100 | 100 |
| 99.0/1.0 | 100 | 100 | 100 |
| Diluent = Microemulsion | | | |
| % BOLD/% Microemulsion | | | |
| 99.5/0.5 | 100 | 100 | 100 |
| 99.0/1.0 | 100 | 100 | 100 |
| Diluent = Macroemulsion | | | |
| % BOLD/% Macroemulsion | | | |
| 99.5/0.5 | 28 | 49 | 65 |
| 99.0/1.0 | 9 | 22 | 40 |

As shown by the UV-Visible readings, the microemulsified silicone fabric care agent permits one to formulate silicone-containing translucent fabric care compositions containing dye, including detergent/fabric softener compositions, which correspond closely to the base colors of the compositions without said agent. This result is also easily observed by visual examination with the microemulsion containing composition very closely resembling the control (water containing) compositions and the macroemulsion compositions being less strongly colored and much less transparent. The microemulsion can be added to a level of about 10% of the liquid detergent composition before any visual signs of cloudiness are observed.

What is claimed is:

1. A liquid fabric care composition comprising:

A. from about 0.05% to about 20% of microemulsified silicone fabric care agent; and B. from about 0.1 ppm to about 1,000 ppm of dye wherein said dye is selected from the group consisting of: C.T. Acid Blue #127.1; C.T. Acid Blue #254; C.T. Direct Blue #199; C.T. Reactive Red #147; C.T. Acid Yellow #79; C.T. Acid Yellow #218; C.T. Direct Yellow #12; Ultramarine Blue; and mixtures thereof.

2. The fabric care composition of claim 1 wherein there is from about 0.5% to about 10% of A. and from about 5 ppm to about 200 ppm of B.

3. The fabric care composition of claim 1 comprising:

(1) an effective amount of suitable microemulsified silicone fabric care agent;

(2) an effective amount of another fabric care compound selected from: detergent surfactant, fabric softener, and mixtures thereof;

(3) An effective amount of dye; and (4) a suitable carrier for (1), (2), and (3) selected from the group consisting of water, C1–4 monohydric alcohols, poly-ols containing 2 to 6 carbon atoms, and mixtures thereof.

4. The composition of claim 3 wherein (2) comprises fabric softener selected from the group consisting of:

i. quaternary ammonium compounds;

ii. fatty amine compounds;

iii. fatty amide compounds;

iv. fatty acids;

v. fatty alcohols; and vi. mixtures thereof.

5. The fabric care composition of claim 4 wherein said silicone fabric care agent is amine functional.

6. The fabric care composition of claim 5 which is an aqueous. liquid containing from about 0.1% to about 20% of said microemulsified silicone fabric care agent and wherein said carrier is primarily water.

7. The fabric care composition of claim 8 wherein said composition contains from about 0.5% to about 10% of said microemulsified silicone.

8. The fabric care composition of claim 4 wherein:

(a) said microemulsified silicone fabric care agent is amine functional, has an average molecular weight of from about 1,000 to about 1,000,000 and is present at a level of from about 0.05% to about 25%; and (b) said fabric softener is present at a level of from about 3% to about 35% by weight of the total composition; and wherein the ratio of said microemulsified silicone fabric care agent to said fabric softener is from about 17:1 to about 1:350.

9. The fabric care composition of claim 8 wherein said ratio of silicone fabric care agent to fabric softener is from about 10:1 to about 1:100.

10. The fabric care composition of claim 9 wherein said ratio of silicone fabric care agent to fabric softener is from about 1:1 to about 1:10.

11. The fabric care composition of claim 10 wherein said ratio of silicone and fabric softener is from about 1:5 to about 1:10.

12. The fabric care composition of claim 4 wherein said fabric softener comprises quaternary ammonium compound.

13. The fabric care composition of claim 12 wherein said fabric softener comprises fatty amine compound.

14. The fabric care composition of claim 12 wherein said fabric softener comprises fatty amide compound.

15. The fabric care composition of claim 12 wherein said fabric softener comprises a mixture of fatty amide, amine and quaternary ammonium compounds.

16. The fabric care composition of claim 3 comprises an effective amount of surfactant, wherein said surfactant is selected from the group consisting of: anionic, nonionic, amphoteric, zwitterionic and cationic surfactants, and mixtures thereof, and said composition is a liquid laundry detergent composition.

17. The fabric care composition of claim 16 containing from about 0.05% to about 20% by weight of said microemulsified silicone agent.

18. The fabric care composition of claim 14 containing from about 0.1% to about 10% of said microemulsified silicone agent.

19. The fabric care composition of claim 18 containing from about 0.2% to about 5% of said microemulsified silicone and wherein said carrier is primarily water.

20. The fabric care composition of claim 19 wherein said microemulsified silicone agent has an average molecular weight of from about 1,000 to about 500,000.

21. The fabric care composition of claim 20 wherein said microemulsified silicone agent has an average molecular weight of from about 1,000 to about 100,000.

22. The fabric care composition of claim 21 wherein said composition is a detergent/softener composition.

23. The fabric care composition of claim 1 wherein said microemulsified silicone is made by emulsion polymerization of lower molecular weight silicone polymers, silicone monomer, or mixtures thereof.

24. The fabric care composition of claim 23 wherein said microemulsified silicone is made by emulsion polymerization of lower molecular weight silicone polymers.

* * * * *

UNITED STATES PATENT AND TRADEMARK OFFICE

CERTIFICATE OF CORRECTION

PATENT NO. : 5,071,573

DATED : December 10, 1991

INVENTOR(S) : TIMOTHY W. COFFINDAFFER and GERALDINE M. COFFEY

It is certified that error appears in the above-identified patent and that said Letters Patent is hereby corrected as shown below:

Col. 2, line 52, "disc osed" should read -- disclosed --.

Col. 6, line 57, "switterionic" should read -- zwitterionic --.

Col. 6, line 66, "The" should read -- 1. The --.

Col. 7, line 50, "$NR_2{}^7$" should read -- $NR^7{}_2$ --.

Col. 7, line 66, "Ordinary" should read -- 1. Ordinary --.

Col. 8, line 62, "Zwitterionic" should read -- zwitterionic --.

Col. 11, line 29, "c.EXAMPLE IV" should read -- EXAMPLE IV --.

Col. 11, line 33, "0-20 ppm" should read -- 10-20 ppm --.

IN THE CLAIMS:

Col. 13, line 42, "8" should read -- 6 --.

Col. 14, line 49, "monomer" should read -- monomers --.

Signed and Sealed this

Twenty-sixth Day of October, 1993

Attest:

Bruce Lehman

BRUCE LEHMAN

Attesting Officer

Commissioner of Patents and Trademarks